US006391447B1

(12) United States Patent
Kornfeldt et al.

(10) Patent No.: US 6,391,447 B1
(45) Date of Patent: May 21, 2002

(54) METHOD FOR MANUFACTURING AN ELECTRIC DEVICE HAVING AN INSULATION SYSTEM IMPREGNATED WITH A DIELECTRIC FLUID

(75) Inventors: Anna Kornfeldt, Västerås; Johan Felix, Sundbyberg; Mikael Bergkvist, Uppsala; Per Nordberg, Karlskrona, all of (SE)

(73) Assignee: ABB AB, Vasteras (SE)

( * ) Notice: Subject to any disclaimer, the term of this patent is extended or adjusted under 35 U.S.C. 154(b) by 0 days.

(21) Appl. No.: 09/582,086

(22) PCT Filed: Dec. 15, 1998

(86) PCT No.: PCT/SE98/02314

§ 371 Date: Aug. 3, 2000

§ 102(e) Date: Aug. 3, 2000

(87) PCT Pub. No.: WO99/33071

PCT Pub. Date: Jul. 1, 1999

(30) Foreign Application Priority Data

Dec. 22, 1997 (SE) ..... 9704829

(51) Int. Cl.[7] ..... D02G 3/00; B05D 5/12; H01B 13/00

(52) U.S. Cl. ..... 428/396; 428/375; 428/379; 428/377; 427/117; 427/118; 427/434.6; 427/439; 156/48; 156/53

(58) Field of Search ..... 427/117, 118, 427/121, 116, 434.6, 439; 428/375, 379, 396, 377; 156/48, 53

(56) References Cited

U.S. PATENT DOCUMENTS 3,748,372 A * 7/1973 McMahon et al. ..... 174/25 R
3,934,332 A * 1/1976 Trunzo ..... 29/605
3,974,302 A * 8/1976 Croop et al. ..... 427/21
4,133,970 A * 1/1979 Lusk ..... 174/19
4,190,682 A * 2/1980 Shaw ..... 427/79
4,234,755 A * 11/1980 Simons ..... 174/19
5,370,808 A * 12/1994 Onishi et al. ..... 252/51.5
5,461,195 A * 10/1995 Freeman et al. ..... 174/23 R
5,714,715 A * 2/1998 Sundhararajan et al. ..... 174/20
6,010,743 A * 1/2000 Berger ..... 427/79
6,154,357 A * 11/2000 Berger ..... 361/314

FOREIGN PATENT DOCUMENTS

| | | | |
|---|---|---|---|
| EP | 058022 | * | 8/1982 |
| EP | 0231402 | * | 8/1987 |
| EP | 586158 | * | 3/1994 |
| GB | 2002684 | * | 2/1979 |
| GB | 2100188 | * | 12/1982 |
| GB | 2131045 | * | 6/1984 |
| WO | WO 97/04466 | | 2/1997 |
| WO | WO99/33068 | * | 7/1999 |
| WO | WO99/33071 | * | 7/1999 |

* cited by examiner

*Primary Examiner*—Cynthia H. Kelly
*Assistant Examiner*—J. M. Gray
(74) *Attorney, Agent, or Firm*—Dykema Gossett PLLC

(57) ABSTRACT

A method for manufacture of an electric device having at least one conductor and a porous, fibrous and/or laminated electrically insulating dielectric system comprising a solid electrically insulating part impregnated with a dielectric fluid and a porous, fibrous and/or laminated body for use in an electric device produced with the method. The method comprises the steps of: providing a conductor and a porous, fibrous and/or laminated structure of a solid electrically insulating material associated with each other, pretreating the porous, fibrous and/or laminated body with a gelling additive such that the body comprises the gelling additive which imparts a high viscosity and elasticity to the fluid at conditions for which the device is designed to operate under, impregnating the pretreated body comprising the gelling additive with the dielectric fluid, wherein the gelling additive upon impregnation is brought into contact with the dielectric fluid and the gelling additive, at least in part, is dissolved by the fluid such that following the impregnation the dielectric fluid is gelled.

27 Claims, 1 Drawing Sheet

METHOD FOR MANUFACTURING AN ELECTRIC DEVICE HAVING AN INSULATION SYSTEM IMPREGNATED WITH A DIELECTRIC FLUID

TECHNICAL FIELD

The present invention relates to a method for manufacturing an insulated electric device comprising at least one current- or voltage-carrying body, i.e. a conductor, and a dielectric such as an electrically insulating dielectric system. The dielectric system comprises an electrically insulating solid part that is porous, fibrous, fibrous and/or laminated and which is impregnated with a dielectric fluid, such as oil or a mass.

The present invention relates in particular to a method for manufacturing an insulated electric DC cable comprising a conductor and an impregnated insulation system. The impregnated insulation system comprises a plurality of layers, such as an inner semi-conducting layer, an insulation and an outer semi-conduction layer. The present invention also relates to the manufacture of other static electric machines, such as transformers, capacitors and the like. In another aspect the present invention relates to a porous, fibrous and/or laminated body to be used in such a process for manufacturing an electric device comprising a conductor and an impregnated, porous, fibrous and/or laminated insulation system and the use of such body in an electric device.

BACKGROUND ART

Many of the first electrical supply systems for transmission and distribution of electrical power were based on DC technology. However, these DC systems were rapidly superseded by systems using alternating current, AC. The AC systems had the desirable feature of easy transformation between generation, transmission and distribution voltages. The development of modern electrical supply systems in the first half of this century was exclusively based on AC transmission systems. By the 1950s there was a growing demand for long transmission schemes and it became clear that in certain circumstances there could be benefits by adopting a DC based system. The foreseen advantages include a reduction of problems encountered in association with the stability of the AC-systems, a more effective use of equipment as the power factor of the system is always unity and an ability to use a given insulation thickness or clearance at a higher operating voltage. Against these very significant advantages has to be weighed the cost of the terminal equipment for conversion of the AC to DC and for inversion of the DC back again to AC. However, for a given transmission power, the terminal costs are constant and therefore, DC transmission systems are economical for schemes involving long distances, such as for systems intended for transmission from distant power plants to consumers but also for transmission to islands and other schemes with transmission distances where the savings in the transmission equipment exceeds the cost of the terminal plant.

An important benefit of DC operation is the virtual elimination of dielectric losses, thereby offering a considerable gain in efficiency and savings in equipment. The DC leakage current is of such small magnitude that it can be ignored in current rating calculations, whereas in AC cables dielectric losses cause a significant reduction in current rating. This is of considerable importance for higher system voltages. Similarly, high capacitance is not a penalty in DC cables.

As in the case of AC transmission cables, transient voltages is a factor that has to be taken into account when determining the insulation thickness of DC cables. It has been found that the most onerous condition occurs when a transient voltage of opposite polarity to the operating voltage is imposed on the system when the cable is carrying full load. If the cable is connected to an overhead line system, such a condition usually occurs as a result of lightning transients.

A typical DC-transmission cable include a conductor and an insulation system comprising a plurality of layers, such as an inner semi-conductive shield, an insulation body and an outer semiconductive shield. The cable is also complemented with casing, reinforcement, etc., to withstand water penetration and any mechanical wear or forces during, production installation and use. Almost all the DC cable systems supplied so far have been for submarine crossings or the land cable associated with them. For long crossings the mass-impregnated solid paper insulated type cable is chosen because there are no restrictions on length due to pressurizing requirements. It has to date been supplied for operating voltages of up to 450 kV. The voltage is likely to be increased in the near future. To date a wound body comprising an essentially all paper tape, i.e. a tape based on paper or cellulose fibers, is used but application of laminated tape materials such as a laminated polypropylene paper tape is being persued. The wound body is typically impregnated with an electric insulation oil or mass. A commercially available insulated electric DC-cable such as a transmission or distribution cable designed for operation at a high voltage, i.e. a voltage above 100 kV, is typically manufactured by a process comprising the winding or spinning of a porous, fibrous and/or laminated solid insulation based on cellulose or paper fiber followed by the impregnation with the electric insulating oil. The impregnation, that typically is carried out in batches after the insulation has been applied around the conductor, is time consuming and needs to be carefully monitored and controlled. For impregnation of a DC-cable, where several kilometers of cable is impregnated with a typically viscous fluid, the process has a process cycle time extending over days or even weeks or months. In addition, this time consuming impregnation process is made according to a carefully developed and strictly controlled process cycle with specified ramping of both temperature and pressure conditions in the impregnation vessel used during heating, holding and cooling to ensure a complete and even impregnation of the fiber-based insulation.

A transformer or a reactor for use in a DC-transmission network, at a power generating utility or at a large consumer installation such as an industrial plant also typically comprises porous, fibrous and/or laminated insulating bodies disposed around and between conductors. Typically preformed bodies, such as so called pressboards, manufactured by dewatering and/or pressing a slurry comprising the fibers are used. The bodies are impregnated by a dielectric fluid to impart the desired electrical properties needed. The impregnation of these bodies in a transformer, although not time consuming, is a sensitive process and specific demands are put on the fluid, the medium to be impregnated and the process variables used for impregnation.

A capacitor exhibits a laminated structure with a dielectric medium comprising one or more polymeric films disposed between two electrodes. Typically films of polyolefin or thermoplastic polyester are used. The capacitor is typically impregnated with a dielectric fluid. The impregnation of the laminated structure of a capacitor, although not time consuming, is a sensitive process and specific demands are put on the fluid, the medium to be impregnated and the process variables used for impregnation.

The active part of the impregnated insulation systems described in the foregoing is the solid part, such as the cellulose fibers, the polymeric films or any laminate or tape used. The dielectric fluid protects the insulation against moisture pick-up and fills all pores, voids or other interstices, whereby any dielectrically weak air contained in the insulation is replaced by the dielectric fluid.

To ensure a good impregnation result, a fluid exhibiting a low-viscosity is desired. But the fluid shall also preferably be viscous at operation conditions for the electrical device to avoid migration of the fluid. Darcy's law (1) is often used to describe the flow of a fluid through a porous, fibrous or capillary medium.

$$(1):\ v = \frac{k\,\Delta P}{\mu L}$$

Where v is the so called Darcy velocity of the fluid, defined as the volume flow divided by the sample area, k is the permeability of the porous medium, ΔP is the pressure difference across the sample, $\mu$ is the dynamical viscosity of the fluid and L is the thickness of the sample. The flow velocity of a fluid within a porous medium will thus be essentially reciprocally proportional to the viscosity, and a fluid exhibiting a low-viscosity or a highly temperature dependent viscosity at operating temperature tends to migrate under the influence of temperature fluctuations that naturally occur in an electric device operating under high loads and also due to a temperature gradient building up across a conductor insulation during such operation. Such migration might result in the formation of unfilled voids in the insulation. Any problem associated with migration of the dielectric fluid must be carefully considered. Unfilled voids or other unfilled interstices or pores might constitute a site for initiation of dielectric breakdown. Thus it is desirable that the dielectric should exhibit a low-viscosity under impregnation and be highly viscous under operation conditions.

Conventional dielectric fluids used for impregnating a porous, fibrous or laminated conductor insulation as for example in a DC cable for transmission of electric power exhibit a viscosity that decreases essentially exponential as the temperature increases. The impregnation temperature must be substantially higher than the operation temperature to gain the required decrease in viscosity due to the low temperature dependence of the viscosity. In comparison the temperature dependency of the viscosity at temperatures prevailing during operation, is high. Small variations in impregnation or operation conditions thus effect the performance of the dielectric fluid and the impregnated insulation. Dielectric fluids are therefore typically chosen such that they are sufficiently viscous at expected operation temperatures to be essentially fully retained in the insulation also under the temperature fluctuations that occur in the electric device during operation. Further the retention of the fluid shall be unaffected of any temperature gradient building up over an insulation. This is achieved by allowing a high impregnation temperature. Such high impregnation temperatures are however disadvantageous as they risk affecting the insulation material, the surface properties of the conductor and promote chemical reactions within and between any material present in the device. Also energy consumption during production and overall production costs will be negatively affected by a high impregnation temperature. Another aspect to consider is the thermal expansion and shrinkage of the insulation which implies that the cooling rate during cooling must be controlled and slow, adding further time and complexity to an already time consuming and complex process. Other types of oil impregnated cables employ a low viscosity oil. However these cables then comprise tanks or reservoirs along or associated with the cable to ensure that the cable insulation remains fully impregnated upon thermal cycling experienced during operation. With these cables, filled with a low viscosity oil, there is a risk for oil spillage from a damaged cable. Therefore a cable impregnated with an oil exhibiting a highly temperature dependent viscosity and with a high viscosity at operating temperature is preferred.

To impart a suitable increased temperature dependency in the viscosity for a conventional mineral oil, it is known to add and dissolve a polymer, e.g. polyisobuthene, in the oil. This can only be achieved for highly aromatic oils. However, such oils exhibit poorer electric properties in comparison with more naphtenic oils. These latter are oil types suitable for use as an electric insulation oil. A more aromatic oil must typically be treated with bleaching earth to exhibit acceptable electric properties. Such processing is costly and there is a risk that small sized clay-particles remain in the oil if not a careful filter- or separation-processing is carried out after this treatment. Alternatively an oil as disclosed in US-A-3 668 128 with additions of from 1 up to 50 percent by weight of an alkene polymer with a molecular weight in the range 100–900 derived from an alkene with 3, 4 or 5 carbon atoms, e.g. polybutene can be chosen for its low viscosity at low temperatures. This oil exhibits a low viscosity at low temperatures, good oxidation resistance and also good resistance to gassing, i.e. the evolution of hydrogen gas which might occur, especially when an oil of low aromatic content, as the oil suggested in US-A-3 668 128, is exposed to electrical fields. However, the oil according to the disclosure in US-A-3 668 128, although offering a major advance on the traditional electrical insulating oil for impregnation of fibrous or laminated insulations, still suffers the risk of oil migration caused by temperature fluctuations and/or temperature gradient building up under operation as the low viscosity oil is typically not retained during operation at elevated temperatures.

The earlier not yet published International Patent Application PCT/SE97/01095 discloses a DC-cable impregnated with a gelling dielectric fluid. The dielectric fluid comprises a gelling polymer based additive that imparts to the fluid a thermo reversible transition between a gelled state at low temperatures and an essentially Newtonian easy flowing state at high temperatures. This substantial transition in viscosity occurs over a limited temperature range. The fluid and the gelling polymer based additive are matched to optimize high temperature viscosity of the easy flowing Newtonian fluid, low temperature viscosity of the gel and the transition temperature range to suit the desired properties both during impregnation and operation. Such a cable with a dielectric fluid matched with a suitable polymer based additive exhibits a substantial potential for reduction of the time period needed for impregnation but it still requires a strictly controlled temperature cycle during impregnation. The gelling polymer based additive and the dielectric fluid is matched to at the same time meet the typically conflicting demands during impregnation and use of the cable. There is today a strong desire to further reduce impregnation temperatures and at the same time to increase the current densities in the DC-cables, and thus the operation temperatures in the DC-cable. This implies that the gap between the impregnation temperature and operation temperature is reduced. Consequently it will be harder to match the specific demands even with sophisticated systems. It must be remembered that not only shall essentially all voids and interstices of the insulation be filled by the fluid but the fluid shall also be retained in this insulation as the temperature fluctuates and temperature gradients build up during the operation the apparatus. Suitable gelling systems comprising oils with additions of polymers but for other purposes are discussed in the European Patent Publication EP-A1-0 231 402 that discloses a gelling compound with slow forming and thermally reversible gelling properties intended to be used as an encapsulant to ensure a good sealing and blocking of any interstices in the a cable comprising an all solid insulation, such as an extruded polymer based insulation. The slow-forming thermally reversible gelling compound comprises an admixture of a polymer to a naphtenic or paraffinic oil, and also embodiments using further admixtures of a co-monomer and/or a block copolymer to an oil are considered suitable as an encapsulant due to their hydrofobic nature and the fact that they can be pumped into the interstices at a temperature below the maximum service temperature of the encapsulant itself. Similar gelling compounds for the same purpose, i.e. the use as encapsulant to block water from entering and spreading along interstices and internal surfaces in a cable comprising solid polymeric insulations, solid semi-conducting shields and metallic conductors, are also known from the European Patent Publications, EP-A1-0 058 022 and EP-A1-0 586 158.

Thus there is an outspoken need for a method for production of an electric device which exhibits an impregnated dielectric system that ensures stable dielectric properties and allows higher operation temperatures without raising the impregnation temperature. The method shall be capable and suitable for production of an electric device designed for operation where the impregnated dielectric during operation is subjected to a high voltage direct current field in combination with thermal fluctuations and/or a thermal gradient. The dielectric fluid employed for impregnation shall during impregnation exhibit a sufficiently low viscosity, which is deemed suitable and technically and economically favorable for impregnation. Further the fluid shall after impregnation exhibit a high viscosity and elasticity such that it during operation, will be essentially retained in the porous, fibrous and/or laminated insulation body at all temperatures within the range of temperatures for which it is designed to operate. It is further the object that the dielectric fluid shall exhibit a sufficiently low viscosity prior to and during impregnation to ensure stable flow properties and flow behavior within these ranges, and that the change in viscosity occurring after impregnation is substantial, i.e. the change in viscosity upon impregnation is in the order of hundreds of Pas or more.

In particular there is a need for a process for manufacturing an insulated DC-cable with an electrical insulation system. The cable shall be suitable for use as a transmission and distribution cable in networks and installations for DC transmission and distribution of electric power. The process shall comprise the application and processing of a conductor insulation and exhibit a substantial reduction in any lengthy time consuming batch-treatment such as impregnation. Thereby providing a potential for a substantial reduction in the production time and thus the production costs. Further, in the DC-cable produced the reliability, low maintenance requirements and long working life of conventional DC-cables, comprising an impregnated paper-based insulation shall be maintained or improved. That is, the DC-cable shall have stable and consistent dielectric properties and a high and consistent electric strength, and, as an extra advantage, open for an increase in the electrical strength and thus allow an increase in operation voltages, improved handleability and robustness of the cable.

SUMMARY OF THE INVENTION

According to one aspect of the present invention it is an object to provide a method for production of an electric device as specified in the foregoing. This is according to the present invention achieved by a method as defined in the preamble of claim 1 for the manufacture of an electric device comprising at least one conductor and an impregnated dielectric system or insulation system characterized by the further measures according to the characterizing part of claim 1. The dielectric system in a device produced according to the present invention comprises a porous, fibrous and/or laminated solid part impregnated with a dielectric fluid. Further developments of the invented method are characterized by the features of the additional claims 2 to 26.

According to another aspect of the present invention it is an object to provide an electrically insulating body exhibiting a porous, fibrous and/or laminated structure and intended for use in an electric device after impregnation with a dielectric, wherein the electric device is to be manufactured with a method wherein the dielectric fluid after impregnation is gelled in the presence of a gelling additive such that the dielectric fluid at design conditions exhibits a high viscosity and elasticity. This is for an electrically insulating body according to the preamble of claim 27 accomplished by the feature according to the characterizing part of claim 27.

DESCRIPTION OF THE INVENTION

An electric device with at least one conductor and a porous, fibrous or laminated electrically insulating dielectric system, and where the dielectric system comprises a solid electrically insulating part impregnated with a dielectric fluid and which is produced with a method which comprises the steps of;

- providing a conductor and a porous, fibrous and/or laminated structure of a solid electrically insulating material associated with each other, and
- impregnating with a dielectric fluid, wherein a gelling additive is added to the fluid to impart a high viscosity and elasticity of the fluid at conditions for which the device is designed to operate under, which method according to the present invention is carried out in a manner such that
- the porous, fibrous and/or laminated body is pretreated with the gelling additive such that the body comprises the gelling additive,
- thereafter the body comprising the gelling additive is impregnated with the dielectric fluid,
- the gelling additive upon impregnation is brought into contact with the dielectric fluid, and
- the gelling additive at least in part is dissolved by the fluid such that following the impregnation the dielectric fluid is gelled.

Preferably the porous, fibrous and/or laminated body is impregnated or coated with the gelling additive. A method is provided according to the present invention wherein the gelling additive is added and brought into contact with the fluid in a manner whereby the dielectric fluid retains its easy flowing essentially Newtonian properties during the essential period of the filling phase of the impregnation step, thereafter the gelling additive is brought into contact with the dielectric fluid such that it at least in part is dissolved in the dielectric fluid, and, as the gelling additive is dissolved, it imparts the properties of a highly viscous, elastic gel to the dielectric fluid. The transformation of the easy flowing dielectric fluid to a highly viscous gel can dependent of the combination of gelling additive and dielectric fluid be instant, slow or even delayed. Typically the behavior of a gelling compound exhibiting a thermoreversible gelling transition is imparted to the fluid following impregnation. By instant transformation is meant that the transformation is initiated directly as the gelling additive is contacted and dissolved by the dielectric fluid and that the transformation kinetics are such that the transformation is rapid. The slow transformation is also typically initiated directly upon contact between fluid and gelling additive but the transformation is slowed down by the kinetics of the dissolution and/or transformation. The delayed transformation is typically accomplished by that the gelling additive is present in a physical form whereby it is slowly released or dissolved or that the kinetics of the transition is slow due to mobility aspects of the gelling additive or mass transport kinetics within the fluid or gelling additive. A delayed transformation can also be accomplished by carrying out the impregnation at a temperature above the transition temperature of the thermo reversible gelling or at a temperature sufficiently low to slow down or limit the dissolution of the gelling additive.

According to one embodiment a porous, fibrous, and/or laminated body is formed and thereafter pre-impregnated or otherwise pretreated with the gelling additive before it is impregnated with the dielectric fluid. The insulating body is typically immersed or otherwise soaked with a solution comprising the gelling additive. According to one aspect of this specific embodiment a de-watered and dried insulation body for use in a transformer is formed. The formed and dried body is thereafter pre-impregnated with the gelling additive before it is fixed as an insulation at an electrical winding or other part comprising a conductor in the electrical device. Typically any solvent is then removed by drying before the body is introduced into the device. The pre-impregnated insulation body is thereafter impregnated with the fluid and the gelling additive is upon impregnation brought into contact with the dielectric fluid whereby the gelling additive at least in part is dissolved by the fluid such that following the impregnation the dielectric fluid is gelled.

According to an alternative embodiment the body is formed in the presence of the gelling additive for example by de-watering a fiber comprising slurry and where the gelling additive is added to the slurry prior to de-watering. Alternatively, the gelling additive is incorporated into an electrical grade paper already in the early stages in the paper mill, such that a polymeric tape is provided with a co-extruded coating comprising a gelling additive and the like.

A further alternative embodiment is well suited for a process to manufacture an electric device comprising a laminated dielectric system. It comprises a step wherein any tape or sheet used for lamination is treated with the gelling additive prior to lamination. According to one aspect of this embodiment, suited for a wound insulation such as a cable insulation with a laminated body comprising a multiple of plies, the tape, film or sheet used is treated with the gelling additive as the laminated body is formed. The tapes can either be coated with the gelling additive or impregnated/soaked with the gelling additive in an operation in direct association with the winding or other technique for producing the laminated body. The gelling additive can be applied by spray coating the paper side of the laminate tape, by contacting the paper side of the laminated tape with a solution or dispersion comprising the gelling additive and the like. The gelling additive can be comprised in some tapes only and the content of gelling additives can be varied between tapes or along the length of a tape, thus providing opportunities for achieving a varying viscosity or varying gelling properties within the insulation system, i.e. a viscosity gradient. The gelling additive can also be manufactured into a tape, film, sheet or a string consisting of the gelling additive using a suitable technique such as film blowing, extrusion, calendering. Such a tape, film sheet or string can be co-wound with the insulation tapes if this is deemed suitable for achieving the desired properties of the insulation system.

According to one further embodiment in the gelling additive is unevenly distributed within the body such that the impregnated body exhibits a viscosity gradient. A preferred viscosity gradient exhibits an increased viscosity in the direction towards a conductor. By such an uneven distribution of the gelling additive within the insulation several important aspects can be improved;

- a more complete filling before start of gelling is ensured also for a gelling system that gels almost instantly;
- a self-healing capability is accomplished, i.e. a damaged part of the insulation can be re-impregnated with fluid from other parts,
- a gelling fluid that retains its highly viscous elastic gelled state also when the temperature around the conductor is raised because of high loads used can be obtained.

Typically the dielectric fluid is an electrical insulation oil to which various gelling additives have been added. Generally suitable gelling additives for most types of oils are compounds such as;

- a block copolymer comprising a styrene based block and an olefin based block
- a compound comprising a polar part, group or segment capable of forming hydrogen bonds,
- a compounds comprising polar part, group or segment capable of forming hydrogen bonds and a non polar part soluble in oil,
- a block copolymer comprising polar block capable of forming hydrogen bonds,
- a block copolymer comprising a polar block capable of forming hydrogen bonds and a non polar block soluble in oil,
- a block copolymer comprising an olefinic block and a block with aromatic rings in its backbone structure, sugar based compounds, compounds comprising urea or di-urea. Polymeric compounds as described in the earlier not yet published International Patent Application PCT/SE97/01095 can advantageously be used for at least any a dielectric fluid based on a mineral oil. Gelling additives comprising a polyalkylsiloxane are well suited at least for a dielectric fluid based on a silicone oil while gelling additives comprising a cellulose based compound are suitable for at least any dielectric fluid based on a vegetabilic oil.

According to one preferred embodiment of the present invention the invented method is used for the production of a DC-cable comprising a conductor and an impregnated insulation system. The insulation system typically comprises wound tapes of paper and/or polymeric material. Most common is the use of all-paper tapes or laminated tapes comprising paper and polypropylene films laminated together in a suitable manner. The process for production of an insulated DC-cable according to the present invention includes the following steps;

Laying or otherwise forming a conductor of any desired shape and constitution;

Forming a first inner semi-conducting shield around the conductor;

Forming a porous, fibrous insulating body outside the inner semi-conducting shield, preferably by wounding or spinning a laminated body around a center comprising the conductor and the inner semi-conducting shield;

Forming a second outer semi-conducting shield outside the insulation,

Impregnating the insulation system with a dielectric fluid, and

Providing a sheath or other form of encasing that seals and mechanically protects the cable.

In accordance with the present invention, a gelling additive, in a suitable manner, is incorporated in the wound insulation body such that when the wound insulation, comprising the gelling additive, is impregnated, the fluid is brought into contact with the gelling additive and the gelling additive, at least in part, is dissolved by the fluid. As a result the dielectric fluid is gelled. For an insulated DC-cable with a dielectric electrically insulating system which prior to impregnation has been treated with a gelling additive, the properties of a highly viscous, elastic gel can be imparted to the dielectric fluid in the finished product in a manner whereby the dielectric fluid retains its easy flowing essentially Newtonian properties during the essential period of the filling phase of the impregnation step and, thereafter, as the gelling additive is brought into contact with the dielectric fluid and is at least in part dissolved in the dielectric fluid, the easy flowing fluid is transformed to a highly viscous, elastic gel. Preferably the properties of a gelling compound exhibiting a thermoreversible transition between an easy flowing state at high temperatures and a highly viscous, gelled state at low temperatures is imparted to the fluid following impregnation using a method according to the present invention. The first transformation of the easy flowing dielectric fluid to a highly viscous gel can dependent of the combination of gelling additive and dielectric fluid be instant, slow or even delayed. It can as already been described in the foregoing also be made dependent of the impregnation temperature.

Preferably the tape used for forming the wound body is pretreated with the gelling additive. This pretreatment is according to one preferred embodiment carried out already in the line for tape production, but can of course also be done in a special treatment operation or in connection with the winding. This is the same for all types of tapes being all paper, all polymer or laminates of paper and polymeric films or different polymeric films or meshes, webs, nets or non-woven tapes or sheets. Paper tapes can be coated by spraying or immersing or otherwise contacting the tape with a solution or dispersion comprising the gelling additive. The gelling additive can be added to polymeric films tapes or the like by spraying or extruding the gelling additive on to the polymer. A coating comprising the gelling additive can also be co-extruded with the polymeric tape or film. An electrically insulating body or dielectric with a porous, fibrous and/or laminated structure and intended for use in an electric device after impregnation with a dielectric fluid, comprises according to the present invention a gelling additive to ensure that the dielectric fluid after impregnation is transformed from an easy flowing fluid or liquid to a highly viscous and elastic gel or to a gelling compound with a thermoreversible transition between an easy flowing liquid at high temperatures and a highly viscous and elastic gel at low temperatures.

According to one embodiment the body or the material from which the body is formed is pre-impregnated with the gelling additive. The preformed body intended for use as insulation can in accordance with this embodiment be soaked in or sprayed with a solution or dispersion comprising a gelling additive and thereafter dried before it is fixed in the transformer and impregnated with the transformer oil. Wound insulations such as cable insulations wound from tapes can be formed to pre-impregnated bodies using tapes pretreated with gelling additives for winding the cable insulation. The tapes can be pretreated already in the line for tape production, but the treatment can of course also be done in a special treatment operation or in connection with the winding. This is the same for all types of tapes being all paper, all polymer or laminates of paper and polymeric films or different polymeric films or meshes, webs or nets or non-woven tapes or sheets. Paper tapes can be coated by spraying or immersing or otherwise contacting the paper with a solution or dispersion comprising the gelling additive. The gelling additive can be added to polymeric films tapes or the like by spraying or extruding the gelling additive on to the polymer. A coating comprising the gelling additive can also be co-extruded with the polymeric tape or film.

According to one further embodiment of the present invention the impregnation is advantageously carried out in the presence of a surfactant or a blend of surfactants whereby the impregnation process is further enhanced before initiation of the gelling. The surfactant or system of surfactants can be added either to the fluid or to the porous, fibrous and/or laminated body as deemed suitable from case to case.

To ensure the long term stability of the improved electrical and mechanical properties a gasabsorbing additive is included in the insulating system. A suitable gasabsorbing additive is a low molecular polyiosbutene with a molecular weight less than 1000 g/mole.

Films of the solid type, e.g. of polypropylene or polyethylene or other polyolefin or a thermoplastic polyester such as PET for use in a capacitor can be coated with the gelling additive in a similar manner before the film or films are arranged between the two electrode foils in a laminated capacitor element.

An electric device produced according to the present invention and comprising a dielectric or electrical insulation according to the present invention is ensured long term stable and consistent dielectric properties and a high and consistent electric strength as good as or better than for any conventional electric device comprising such impregnated porous, fibrous and/or laminated body. This is especially important due to the long life such installations typically are designed for, and the limited access for maintenance to such installations. The pretreatment prior to impregnation of the body with an additive comprising a component that imparts the properties of a highly viscous gel or a gelling compound with a thermoreversible transition between a highly viscous gel at low temperatures and an easy flowing liquid at high temperatures ensures the long term stable properties of the insulation system also when used at elevated temperatures, at excessive thermal fluctuations and under thermal gradients. This opens for a capability to allow an increase in the operation load. One further advantage of a device produced according to the present invention is the reduced production time by the shortened impregnation cycle. Also, as the gelling is accomplished without resorting to only the temperature dependency, the temperature sensitivity during production is substantially reduced. The in situ preparation of the gelling compound accomplished in association with the impregnation has the following advantages;

the preparation step to add the gelling additive to the fluid before impregnation is eliminated, the need for special measures needed for handling and transportation of a gelling dielectric fluid comprising a gelling additive is eliminated, the provisions for a low viscosity fluid during impregnation while still ensuring a sufficiently high viscosity upon use are accomplished, this is in particular advantageous for a laminated body, and especially for a laminated body comprising solid type films or tapes, as they are hard to impregnate with conventional high viscosity fluids, short impregnation times, low impregnation temperature reducing risks for thermal damage to the insulation system, providing provisions for delayed gelling as and if the solubility of the gelling additive at is low impregnation temperature is low, this is especially advantageous in laminated systems comprising polymeric films of the solid type as it provides improved flow dynamics during impregnation and good retention after impregnation and gelling, tapes with varying content of gelling additive can be used to accomplish viscosity gradients in any direction or according to any pattern, a precoated, preimpregnated or otherwise pretreated tape might be less hygroscopic and require less drying before being used for manufacture of the body to be impregnated with the dielectric fluid, and the time period for any degassing of the dielectric fluid carried prior to impregnation can be reduced.

BRIEF DESCRIPTION OF THE DRAWINGS

The present invention shall be described more in detail under reference to the drawing and examples.

Figure 1:
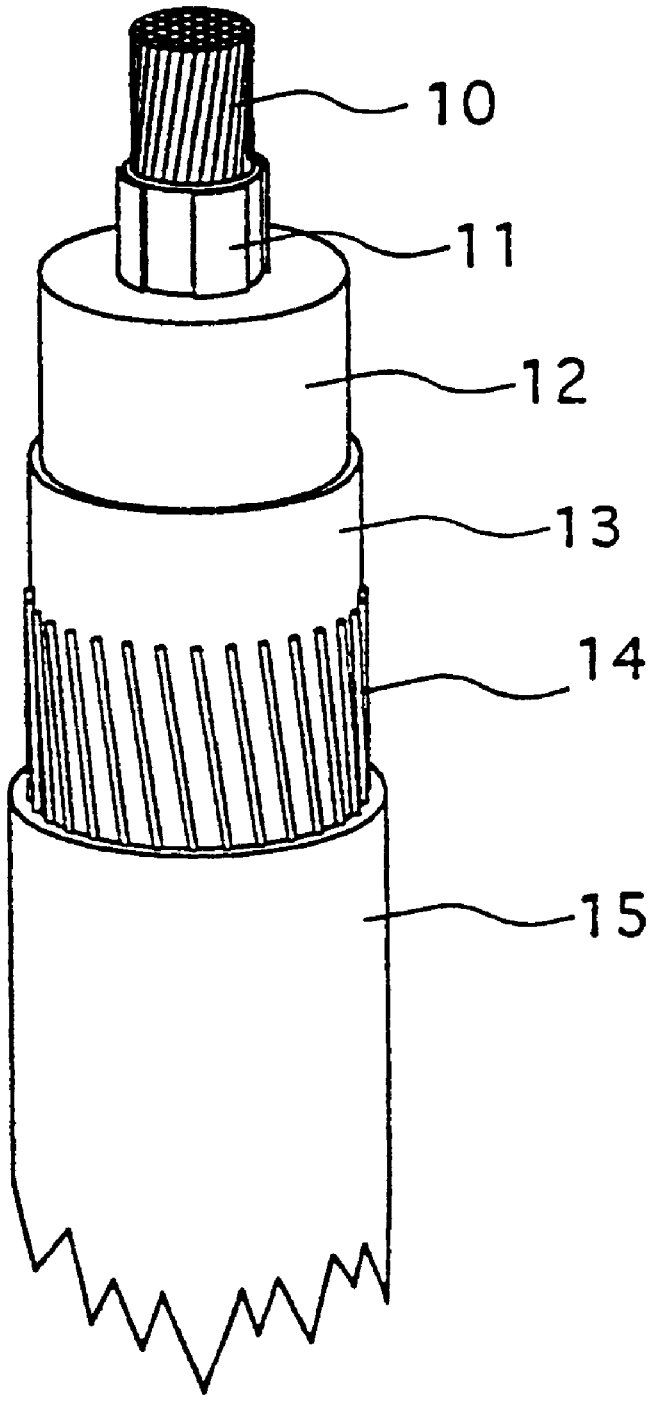
FIG. 1 shows a typical DC-cable for transmission of electric power comprising a wound and impregnated insulation according to the present invention

DESCRIPTION OF PREFERRED EMBODIMENTS, EXAMPLES.

The DC-cable according to the embodiment of the present invention shown in FIG. 1 comprises from the center and outwards;

a stranded multi-wire conductor 10;

a first semi-conducting shield 11 disposed around and outside the conductor 10 and inside a conductor insulation 12;

a wound and impregnated conductor insulation 12 comprising a gelling additive as described in the foregoing;

a second semi-conducting shield 13 disposed outside the conductor insulation 12;

a metallic screen 14; and a protective sheath 15 arranged outside the metallic screen 14. The cable is further complemented with a reinforcement in the form of metallic, preferably steel, wires outside the outer extruded shield 13, a sealing compound or a water swelling powder is introduced in a the interstices in and around the conductor 10.

The method of the present invention is applicable for any arbitrary DC-cable with an insulation system comprising a solid porous or laminated part impregnated with a dielectric fluid or mass. The application of the present invention is independent of conductor configuration. It can also be used with DC-cables having an insulation system of this type comprising any arbitrary functional layer(s) and irrespective of how these layers are configured. Its application to DC-cables of this type is also independent of the configuration of the system for transmission of electric power in which the cable is included.

The DC-cable according to the present invention can be a single multi-wire conductor DC-cable as shown in FIG. 1, or a DC-cable with two or more conductors. A DC-cable comprising two or more conductors can be of any known type with the conductors placed side-by-side in a flat cable arrangement, or in a two conductor arrangement with one first central conductor surrounded by a concentrically arranged second outer conductor. The outer conductor is typically arranged in the form of an electrically conductive sheath, screen or shield, typically a metallic screen not restricting the flexibility of the cable.

A DC-cable according to the present invention is suitable for use in both bipolar and monopolar DC-systems or installations for transmission of electric power. A bipolar system typically comprises two or more associated single conductor cables or at least one multiconductor cable, while a monopolar installation has at least one cable and a suitable current return path arrangement.

A DC-cable according to the embodiment of the present invention shown in the FIG. 1 and comprising a wound and impregnated conductor insulation as defined in the foregoing ensures long term stable and consistent dielectric properties and a high and consistent electric strength as good as or better than for any conventional wound and impregnated cable. This is especially important due to the long life such installations are designed for, and the limited access for maintenance to such installations being installed in remote locations or even sub-sea The pretreatment of the fibrous or solid type tapes with an additive comprising a gelling component before impregnation ensures the long term stable properties of the cable insulation also for a cable used at elevated temperatures, at excessive thermal fluctuations and under thermal gradients. This opens for a capability to allow an increase in the operation load. One further advantage of a DC-cable produced according to the present invention is the reduced production time by the shortened impregnation cycle. Also, as the gelling is accomplished without resorting to only the temperature dependency, the temperature sensitivity during production is substantially reduced.

Example 1

A paper tape of electrical insulation grade was being passed through an aqueous dispersion comprising a styrene-ethylene/butylene triblock copolymer. The treated tape was thereafter dried and subsequently used in the spinning of an insulation body such as a cable insulation. After immersion and drying, the porous, fibrous tape comprised the gelling additive. The tape provided by this treatment was dependent on the degree of soaking of either a coated or impregnated paper tape of electrical insulation grade that contained the styrene-ethylene/butylene triblock copolymer as a gelling additive. The gelling additive was at least in part dissolved in the dielectric fluid upon impregnation. Thereby, the rheology of the dielectric fluid was modified in such a way that it after completion of the impregnation was transformed to a gelling compound, with a thermoreversible transition between a highly viscous state at low temperatures and an easy flowing liquid at high temperatures. The resulting fluid was at typical operation temperatures of an electrical device in the highly viscous and elastic gelled state. The treatment can preferably be carried out in the paper mill, for example in a device for applying coatings to the paper, but can of course also be applied in a special treatment or in connection with the spinning process. The gelling additive can of course also be applied to the paper tape by any other suitable method such as spraying etc.

Example 2

A laminated paper polypropylene tape, a PPLP tape, comprising laminated polypropylene and electrical grade paper films was sprayed on the paper side with the a dispersion comprising 5% by weight of a styrene-ethylene/butylene triblock copolymer in cyclohexane. The treated tape was thereafter dried and subsequently used in the spinning of an insulation body of the type used for cable insulation. After incorporation of the gelling additive and drying, the porous, fibrous paper part of the laminated tape thus comprised this gelling additive. The wound body of treated PPLP tape that in its paper part contained the styrene-ethylene/butylene triblock copolymer as a gelling additive was impregnated with an electrical insulation oil. The gelling additive was at least in part dissolved in the oil upon impregnation. The rheology of the dielectric fluid was following the impregnation modified such that it exhibited the properties of a gelling compound with a thermoreversible transition and was at typical operation temperatures of a DC cable transformed to a highly viscous and elastic gelled state. It would be advantageous from the aspect of costs to carry out this incorporation of the gelling additive in association with the production of the laminated tape, but it can of course also be carried out in a separate special treatment or in connection with the spinning process. The gelling additive can of course also be applied to the paper tape by any other suitable method such as being passed through a bath or over a pad or sponge comprising such a solution.

Example 3

A polypropylene tape was extrusion-coated on one side with a thin coating comprising a styrene-ethylene/butylene triblock copolymer. The thin coating was rapidly solidified and could almost instantly be used for spinning of an insulation body, of the type used in a cable insulation. The coating comprising the gelling additive, was dissolved in the dielectric fluid upon impregnation. The rheology of the dielectric fluid was modified such that it following the impregnation exhibited the behavior of a gelling compound with a thermoreversible transition, and was at normal operation temperatures of a DC cable in a highly viscous and elastic gelled state. This coating can of course also be applied to the nonpaper side of a laminated paper polypropylene tape, a PPLP-tape as in example 2. Also in this case it would be advantageous to apply the coating in connection with the production of the basic tape, e.g. by co-extruding the polypropylene and the a styrene-ethylene/butylene triblock copolymer to form one two-plied tape, which then can be laminated with the paper to a PPLP tape or used as a polypropylene tape, but the extrusion of the copolymer coating can of course also be carried out in a separate special operation or in connection with the spinning process.

Example 4

A coated polypropylene film coated as the tape in example 3 was introduced into a laminated structure between two electrode foils and wound to a wound capacitor element. The capacitor element was included in an assembly of wound capacitor elements connected in series or in parallel, in parallel connected groups of series connected elements or in series connected groups of parallel connected elements. This assembly was installed in a tank or casing and impregnated. The thin coating was slowly dissolved in the dielectric fluid upon impregnation. The rheology of the dielectric fluid/gelling compound was modified in such a way that it during impregnation ensured a complete impregnation of the laminated structure of the capacitor element and following impregnation was transformed to a gelling compound with a thermoreversible transition between a highly viscous gelled state at low temperatures and an easy flowing state at high temperature. The gelling compound was at typical operation temperatures of a capacitor in a highly viscous and elastic gelled state.

Example 5

The same as in example 4, except that the SEBS triblock copolymer coating was extruded onto polyethylene sheets. The sheets were stacked to a layered structure between two thin electrodes and impregnated. The thin coating was slowly dissolved in the dielectric fluid upon impregnation. The rheology of the dielectric fluid/gelling compound was modified in such a way that it during impregnation ensured a complete impregnation of the laminated structure of the capacitor element and following impregnation was transformed to a gelling compound with a thermoreversible transition between a highly viscous gelled state at low temperatures and an easy flowing state at high temperature. The gelling compound was at typical operation temperatures of a capacitor in a highly viscous and elastic gelled state.

Example 6

A fibrous insulation body was formed by de-watering a water based fiber containing slurry. After drying the body was spraycoated with a dispersion comprising 6% by weight of a radial styrene-butadiene block copolymer. The coated body was thereafter dried. The gelling additive was at least partly dissolved in the dielectric fluid upon impregnation of the body. The rheology of the dielectric fluid/gelling compound was modified in such a way that it during impregnation ensured a complete impregnation of the laminated structure of the capacitor element and following impregnation was transformed to a gelling compound with a thermoreversible transition between a highly viscous gelled state at low temperatures and an easy flowing state at high temperature. The gelling compound was at typical operation temperatures of a transformer in a highly viscous and elastic gelled state.

Example 7

A fibrous insulation body was formed by de-watering a water based fiber containing slurry. After drying the body was spray-coated with a solution comprising 4% by weight of a styrene-ethylene/butylene triblock copolymer. The coated body was thereafter dried. The gelling additive was at least partly dissolved in the dielectric fluid upon impregnation of the body. The rheology of the dielectric fluid/gelling compound was modified in such a way that it during impregnation ensured a complete impregnation of the laminated structure of the capacitor element and following impregnation was transformed to a gelling compound with a thermoreversible transition between a highly viscous gelled state at low temperatures and an easy flowing state at high temperature. The gelling compound was at typical operation temperatures of a transformer in a highly viscous and elastic gelled state. The spray-coatings of examples 6 and 7 or any similar coatings comprising a gelling additive can of course also be applied to a press formed and dried fibrous body, and, provided that any extended drying can be accepted, the spray-coating may be replaced by immersion of the body, in a solution comprising the gelling additive. This immersion is likely to increase the capability of introducing the gelling additive also to the internal parts of the body, thus providing a body with a more uniform distribution of the gelling additive.

Example 8

An elongated polypropylene body such as a film, a tape or a sheet was spray-coated with a solution comprising 5% by weight of a styrene-ethylene/butylene triblock copolymer in cyclohexane. The speed at which the elongated body was passed before the spraying die was adjusted to vary the load of the polymer on the polymer surface. The applied coating was thereafter dried by the application of a hot air stream from a hot-air drier, and the body was thereafter immediately incorporated in an insulation body to be impregnated. The gelling additive was at least partly dissolved in the dielectric fluid upon impregnation of the body. The rheology of the dielectric fluid/gelling compound was modified in such a way that it during impregnation ensured a complete impregnation of the laminated structure of the capacitor element and following impregnation was transformed to a gelling compound with a thermoreversible transition between a highly viscous gelled state at low temperatures and an easy flowing state at high temperatures. The gelling compound was at typical operation temperatures of a transformer in a highly viscous and elastic gelled state. The film tape or sheet can be formed to a layered body by winding, stacking or other suitable way by means of which it can be brought into a form to be used as a conductor insulation in e.g. a cable or as a dielectric body disposed between two electrodes in a capacitor. The capacitor can be a wound capacitor element comprising two electrode foils arranged in a laminated structure separated by one or more films or as a capacitor comprising a stacked layered dielectric body between two electrodes.

Example 9

A film consisting of a styrene-ethylene/butylene triblock, SEBS, copolymer was blown. This film was co-wound with a paper based tape to form a cable insulation which was impregnated with a mineral oil. The SEBS film was distributed in the wound body such that upon impregnation a viscosity gradient with a higher viscosity at the center was accomplished for the insulation disposed around the conductor. Upon impregnation of the wound body, the gelling additive at least partly dissolved in the dielectric fluid. The rheology of the dielectric fluid/gelling compound was modified in such a way that it during impregnation ensured a complete impregnation of the laminated structure of the capacitor element and following impregnation was transformed to a gelling compound with a thermoreversible transition between a highly viscous gelled state at low temperatures and an easy flowing state at high temperatures. The gelling compound was at typical operation temperatures of a DC cable in a highly viscous and elastic gelled state.

Example 10

A film consisting of a styrene-ethylene/butylene triblock, SEBS, copolymer was blown. This film was stacked between layers in a dielectric body comprising solid type polymeric films of polyethylene. The body was impregnated. The SEBS film was distributed in the stacked layered body such that a complete filling of the body was ensured before the gelling was initiated. The gelling additive was upon impregnation of the layered body at least partly dissolved in the dielectric fluid The rheology of the dielectric fluid/gelling compound was modified in such a way that it during impregnation ensured a complete impregnation of the laminated structure of the capacitor element and following impregnation was transformed to a gelling compound with a thermoreversible transition between a highly viscous gelled state at low temperatures and an easy flowing state at high temperatures. The gelling compound was at typical operation temperatures of a capacitor in a highly viscous and elastic gelled state.

Example 11

A film consisting of a styrene-ethylene/butylene triblock, SEBS, copolymer was blown. The film was placed between layers in a body comprising two foil electrodes separated by one or more polypropylene films. The body was wound into wound capacitor elements and arranged in an assembly of such capacitor elements. The assembly of capacitor elements was impregnated. The SEBS film was distributed in the wound bodies such that a complete filling of the body was ensured before the gelling was initiated. The gelling additive was upon impregnation of the layered body at least partly dissolved in the dielectric fluid. The rheology of the dielectric fluid/gelling compound was modified in such a way that it during impregnation ensured a complete impregnation of the laminated structure of the capacitor element and following impregnation was transformed to a gelling compound with a thermoreversible transition between a highly viscous gelled state at low temperatures and an easy flowing state at high temperatures. The gelling compound was at typical operation temperatures of a capacitor in a highly viscous and elastic gelled state.

What is claimed is:

1. A method for manufacture of an electric device comprising the steps of:

providing a conductor and a body with at least one of a porous, fibrous and laminated structure of a solid electrically insulating material and associating the body and the conductor with each other;

pretreating the body with a gelling additive; and thereafter impregnating the body with a dielectric fluid for bringing the gelling additive upon impregnation into contact with the dielectric fluid such that the gelling additive, at least in part, is dissolved by the fluid so that the dielectric fluid is gelled.

2. The method according to claim 1, wherein the gelling additive imparts a thermoreversible gelling transition to the dielectric fluid following impregnation.

3. The method according to claim 1, wherein the body is formed in the presence of the gelling additive.

4. The method according to claim 3, wherein the body is formed by dewatering a fiber comprising slurry and the gelling additive is added to the slurry prior to dewatering.

5. The method according to claim 3, wherein the body is laminated into multiple plies of tapes, sheets or films wound about the conductor pretreated with the gelling additive prior to lamination.

6. The method according to claim 5, wherein the tapes, films or sheets are coated with the gelling additive.

7. The method according to claim 5, wherein the tapes, films or sheets are impregnated/soaked with the gelling additive.

8. The method according to claim 5, wherein the tapes, films or sheets comprise the gelling additive.

9. The method according to claim 5, wherein the tapes, films or sheets are wound about a conductor insulation in an impregnated DC-cable.

10. The method according to claim 5, wherein the tapes, films or sheets are wound about a dielectric body including two electrode foils of one or more polymeric films separated by a dielectric forming a capacitor element, impregnated with a dielectric fluid located about the conductor.

11. The method according to claim 3, wherein the body is laminated into multiple plies of tapes, sheets or films wound about the conductor treated with the gelling additive as the laminated body is being formed.

12. The method according to claim 1, wherein the gelling additive is unevenly distributed within the body such that following impregnation the fluid is transformed into a gelling compound that exhibits a viscosity gradient about the conductor.

13. The method according to claim 12, wherein the viscosity gradient increases radially towards the conductor.

14. The method according to claim 1, wherein the gelling additive comprises a block copolymer with a styrene based block and an olefin based block.

15. The method according to claim 1, wherein the gelling additive comprises a polar segment capable of forming hydrogen bonds.

16. The method according to claim 1, wherein the gelling additive comprises a block copolymer comprising a polar block capable of forming hydrogen bonds.

17. The method according to claim 1, wherein the gelling additive comprises a block copolymer comprising a polar block capable of forming hydrogen bonds and a non polar soluble in the dielectric fluid.

18. The method according to claim 1, wherein the gelling additive comprises a block copolymer comprising an olefinic block and a block with aromatic rings in its backbone structure.

19. The method according to claim 1, wherein the gelling additive is a sugar based compound.

20. The method according to claim 1, wherein the gelling additive comprises urea or di-urea.

21. The method according to claim 1, wherein the gelling additive comprises a polyalkylsiloxane.

22. The method according to claim 1, wherein the gelling additive comprises a cellulose based compound.

23. The method according to claim 1, wherein the impregnation is carried out in the presence of a surfactant or a blend of surfactants.

24. The method according to claim 23, wherein the surfactant or blend of surfactants is added to the dielectric fluid prior to impregnation.

25. The method according to claim 23, wherein the surfactant or blend of surfactants is added to the insulation body to be impregnated prior to impregnation.

26. The method according to claim 1, wherein a gas absorbing additive, such as a low molecular polyisobutene, has been added to the insulating system.

27. An electric device comprising:

a conductor and an insulating body for the conductor formed with at least one of a porous, fibrous and laminated structure of a solid electrically insulating material;

a gelling additive associated with the body, and a dielectric fluid associated with the body by impregnation for bringing the gelling additive upon impregnation into contact with the dielectric fluid such that at least a portion of the gelling additive is dissolved by the fluid so that the dielectric fluid is gelled in the body.

* * * * *